US005088695A

United States Patent [19]

Van Laar

[11] Patent Number: 5,088,695

[45] Date of Patent: Feb. 18, 1992

[54] IRON RUNNER

[75] Inventor: Jacobus Van Laar, Driehuis, Netherlands

[73] Assignee: Hoogovens Groep BV, IJuiden, Netherlands

[21] Appl. No.: 664,680

[22] Filed: Mar. 5, 1991

[51] Int. Cl.[5] ..... C21B 7/14

[52] U.S. Cl. ..... 266/196; 266/286

[58] Field of Search ..... 266/196, 231, 286

[56] References Cited

U.S. PATENT DOCUMENTS

| | | | |
|---|---|---|---|
| 4,508,323 | 4/1985 | Fleming | 266/196 |
| 4,573,668 | 3/1986 | LaBate | 266/196 |
| 4,622,678 | 11/1986 | Scarfe | 266/286 |

FOREIGN PATENT DOCUMENTS

| | | |
|---|---|---|
| 0060239 | 9/1982 | European Pat. Off. . |
| 0090761 | 10/1983 | European Pat. Off. . |
| 3149246 | 6/1983 | Fed. Rep. of Germany . |

OTHER PUBLICATIONS

Iron and Steel Engineer, Oct. 1988, pp. 47-51 J. C. Wilson "Casthouse Design of Dofasco's Rebuilt No. 4 Blast Furnace".

*Primary Examiner*—S. Kastler

*Attorney, Agent, or Firm*—Stevens, Davis, Miller & Mosher

[57] ABSTRACT

An iron runner for tapping molten crude iron from a blast furnace is proposed, comprising at least a wear lining which forms a boundary carrying the iron during operation and a permanent lining in which the wear lining is contained, an outer boundary and at least an outer lining with a high coefficient of thermal conductivity which is provided between the outer boundary and the permanent lining, wherein the outer lining is provided with a thickening in the direction of the wear lining, which thickening is applied at the level of the inerface-layer being present during operation between the iron being carried through the runner and a slag layer floating on the iron.

2 Claims, 1 Drawing Sheet

IRON RUNNER

FIELD OF THE INVENTION

The invention relates to an iron runner for tapping molten crude iron from a blast furnace

BACKGROUND OF THE INVENTION AND DESCRIPTION OF THE PRIOR ART

An iron runner comprises at least a wear lining which forms a boundary carrying the iron during operation and a permanent lining in which the wear lining is contained, a steel or concrete outer boundary and at least an outer lining with a high coefficient of thermal conductivity which lining is provided between the outer boundary and the permanent lining.

Such an iron runner is known from the 'Iron & Steel Engineer' of October 1988. pages 47–51. A problem of this known iron runner is the substantial wear which occurs especially at the level of the iron/slag interface-layer, and which eventually necessitates repair of the wear lining carrying iron during operation. This is particularly a problem because this wear is quite substantial in the vicinity of the interface-layer due to the highly abrasive action of the slag, which when repairing makes it necessary to pull down a wear lining that is still intact for the greater part.

OBJECTS OF THE INVENTION

The object of the invention is to make the wear of the wear lining proceed more evenly, which enables the service life of the iron runner to be prolonged and the iron runner to be operated at lower operational costs.

SUMMARY OF THE INVENTION

The object of the invention is attained according to the instant invention in that the outer lining is provided with a thickening in the direction of the wear lining, which thickening is applied at the level of the interface-layer being present during operation between the iron being carried through the runner and a slag layer floating on the iron.

Surprisingly it has been found that the better cooling of the wear lining obtained by this, at the level of the iron/slag interface-layer being present during operation, counteracts the wear of the wear lining there. This effect is highly enhanced by the embodiment of the iron runner in which the thickening of the outer lining adjoins directly the permanent lining.

DESCRIPTION OF THE DRAWING

In the following the invention will be illustrated by reference to the drawing of a non-limitative example of embodiment of the iron runner in accordance with the invention.

DESCRIPTION

Figure 1:
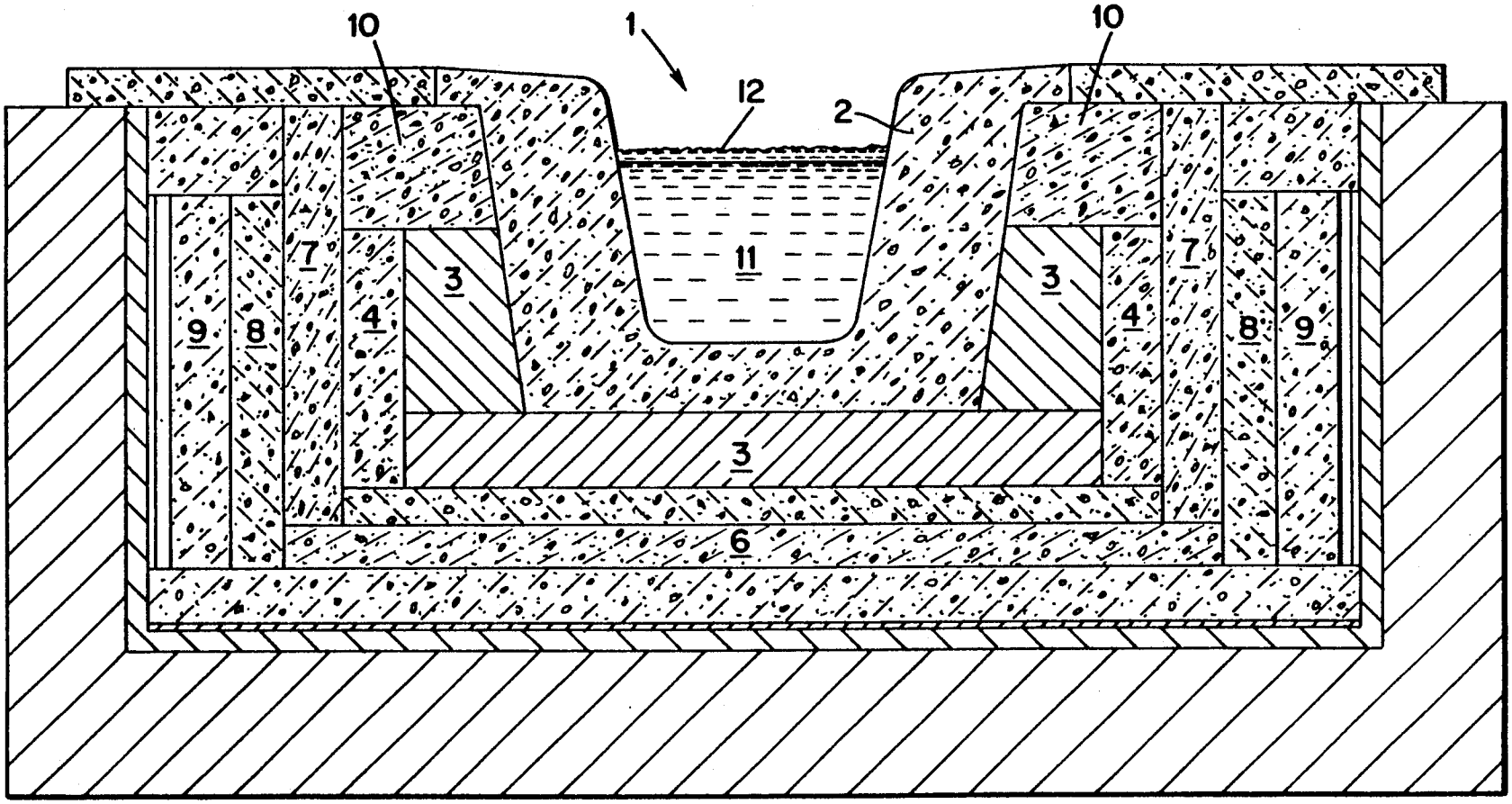
FIG. 1 shows a cross-section of the iron runner in accordance with the invention.

In FIG. 1 the iron runner (1) is shown of which the boundary carrying the iron is formed by a wear lining (2). For the wear lining (2), which may consist of a number of layers able to move relative to each other, different kinds of material may be used, but it is normal to use a refractory concrete for this. Directly adjoining the wear lining (2) a carbon intermediate lining (3) may be used as a permanent lining for temperature equalisation of the wear lining (2). However, this intermediate lining (3) is not essential to the invention. Adjoining this intermediate lining (3) and in the absence thereof, adjoining the wear lining (2), an insulating layer (4) is provided which consists of a refractory concrete. The outer lining (6, 7) consists of a bottom plate (6) and side walls (7) which are thermally interconnected.

By using carbon, graphite or semi-graphite, but preferably graphite for the outer lining (6, 7) the required thermal conductivity is obtained in this place and it is possible to apply insulating refractory lining layers (8. 9) directly adjoining the side walls (7).

In accordance with the invention the thermally high-conducting side walls (7) of the iron runner (1) are now also provided with a thickening (10) in the direction of the wear lining (2), which thickening (10) is applied at the level of the interface-layer being present during operation between the iron (11) being carried and the slag layer (12) floating on it. Preferably the thickening (10) adjoins directly the wear lining (2). By this an especially effective local cooling of the wear lining (2) is obtained at the level of the iron/slag interface-layer, by which the wear of the wear lining (2) at the level of said interface-layer is counteracted and a longer service life of the wear lining is achieved.

What is claimed is:

1. Iron runner for tapping molten crude iron from a blast furnace, comprising at least a wear lining which forms a boundary carrying the iron during operation and a permanent lining in which the wear lining is contained, an outer boundary and at least an outer lining of carbon, graphite or semi-graphite with a high coefficient of thermal conductivity which lining is provided between the outer boundary and the permanent lining, said outer lining being provided with a thickening in the direction of the wear lining, which thickening is applied at the level of the interface-layer being present during operation between the iron being carried through the runner and a slag layer floating on the iron.

2. Iron runner in accordance with claim 1, characterised in that the thickening of the outer lining adjoins directly the wear lining.

* * * * *